US009689349B2

(12) United States Patent
Matsunaga et al.

(10) Patent No.: US 9,689,349 B2
(45) Date of Patent: Jun. 27, 2017

(54) FUEL EVAPORATIVE EMISSION CONTROL APPARATUS

(71) Applicant: Mitsubishi Jidosha Kogyo Kabushiki Kaisha, Tokyo (JP)

(72) Inventors: Hideo Matsunaga, Okazaki (JP); Hitoshi Kamura, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 137 days.

(21) Appl. No.: 14/670,168

(22) Filed: Mar. 26, 2015

(65) Prior Publication Data

US 2015/0275790 A1 Oct. 1, 2015

(30) Foreign Application Priority Data

Mar. 27, 2014 (JP) ..... 2014-066842
Mar. 27, 2014 (JP) ..... 2014-066843

(51) Int. Cl.
*F02M 25/08* (2006.01)
*F02D 41/00* (2006.01)

(52) U.S. Cl.
CPC ..... *F02M 25/0809* (2013.01); *F02M 25/089* (2013.01); *F02M 25/0836* (2013.01); *F02D 41/0035* (2013.01); *F02M 25/0818* (2013.01)

(58) Field of Classification Search
CPC ..... F02M 25/0809; F02M 25/0836; F02M 25/089; F02M 25/0818; F02D 41/0035
See application file for complete search history.

(56) References Cited

U.S. PATENT DOCUMENTS 5,758,628 A * 6/1998 Wada ..... F02M 25/0809 123/198 D
5,780,728 A * 7/1998 Takamori ..... F02M 25/0809 73/114.39
6,047,692 A * 4/2000 Toyoda ..... F02M 25/089 123/516
6,105,708 A * 8/2000 Amano ..... B60K 15/03504 180/309
6,564,781 B2 * 5/2003 Matsumoto ..... F02M 25/0809 123/519
6,698,280 B1 * 3/2004 Iden ..... F02M 25/0818 73/114.38
6,782,874 B1 * 8/2004 Matsumoto ..... F02M 25/0809 123/198 D (Continued)

FOREIGN PATENT DOCUMENTS

JP 2002357163 A * 12/2002
JP 2004346792 A * 12/2004
JP 3620402 B2 2/2005

*Primary Examiner* — Joseph Dallo
(74) *Attorney, Agent, or Firm* — Birch, Stewart, Kolasch & Birch, LLP

(57) ABSTRACT

A fuel evaporative emission control apparatus executes a first leak presence/absence determination for determining the presence or absence of leaks of fuel evaporative gases based on the detection results of a tank pressure detection portion, with a first opening/closing portion being closed, a second opening/closing portion being opened, and a third opening/closing portion being closed. The fuel evaporative emission control apparatus can determine whether leaks of fuel evaporative gases are present or absent, can pinpoint the location of the leaks, and can detect a sensor abnormality.

20 Claims, 6 Drawing Sheets

(56) References Cited

U.S. PATENT DOCUMENTS

| | | | | |
|---|---|---|---|---|
| 7,313,487 | B2 * | 12/2007 | Yoshioka | F02M 25/0809 702/51 |
| 7,469,686 | B2 * | 12/2008 | Kano | F02M 25/0809 123/198 D |
| 7,500,474 | B2 * | 3/2009 | Kano | F02M 25/0809 123/520 |
| 9,151,251 | B2 * | 10/2015 | Matsunaga | F02M 25/0809 |
| 9,382,879 | B2 * | 7/2016 | Matsunaga | F02M 25/0818 |
| 2002/0179066 | A1 * | 12/2002 | Matsumoto | F02M 25/0809 123/520 |
| 2006/0225714 | A1 * | 10/2006 | Kano | F02M 25/0809 123/520 |
| 2007/0044549 | A1 * | 3/2007 | Yoshioka | F02M 25/0809 73/114.39 |
| 2007/0266998 | A1 * | 11/2007 | Kano | F02M 25/0809 123/519 |
| 2013/0008414 | A1 * | 1/2013 | Matsunaga | F02M 25/0836 123/519 |
| 2013/0008415 | A1 * | 1/2013 | Matsunaga | F02M 25/0836 123/520 |
| 2014/0174411 | A1 * | 6/2014 | Matsunaga | F02M 25/0836 123/520 |
| 2015/0114361 | A1 * | 4/2015 | Matsunaga | F02M 25/0818 123/520 |

* cited by examiner

FUEL EVAPORATIVE EMISSION CONTROL APPARATUS

The entire disclosure of Japanese Patent Applications Nos. 2014-066842 filed on Mar. 27, 2014 and 2014-066843 filed on Mar. 27, 2014 is expressly incorporated by reference herein.

TECHNICAL FIELD

This invention relates to a fuel evaporative emission control apparatus for introducing fuel evaporative gases within a fuel tank into an intake system of an engine to suppress emissions into the atmosphere and, in particular, relates to a technology for detecting leaks (leakage) of fuel evaporative gases.

BACKGROUND ART

Fuel evaporative gases generated within a fuel tank become a cause of air pollution. Thus, a vehicle having an engine loaded thereon is generally loaded with a fuel evaporative gas treatment device for suppressing the emission of the fuel evaporative gases into the atmosphere. The fuel evaporative gas treatment device is configured, for example, to connect the fuel tank and an intake system of the engine by a purge conduit equipped with a canister so as to adsorb the fuel evaporative gases, which have been generated within the fuel tank, to activated carbon within the canister once, and introduce fuel adsorbed to the activated carbon into the intake system of the engine in response to the intake negative pressure of the engine, thereby burning the fuel together with fresh air.

In recent years, vehicles having a traveling motor along with an engine, such as plug-in hybrid electric vehicles (PHEV) and hybrid electric vehicles (HEV), have found practical use. With such vehicles equipped with the traveling motor, the period of engine stoppage, namely, the period during which fuel cannot be introduced from the canister into the intake system of the engine, may continue relatively long. Thus, a so-called closed type fuel evaporative emission control apparatus, in which a containment valve is provided between the fuel tank and the canister, and this containment valve remains closed during the period of the engine stopping, has been developed. Among the closed type fuel evaporative emission control apparatuses is one, for example, in which an on-off valve is provided near an inlet of the canister and, when the on-off valve is closed, fuel evaporative gases are not introduced into the canister, but directly introduced into the intake system of the engine.

In the fuel evaporative emission control apparatus of the above configuration, leaks of fuel evaporative gases in case of trouble, if any, would directly lead to air pollution. In the United States, etc., therefore, it is legally obligated to detect leaks of fuel evaporative gases. Under the laws and regulations of the United States, in particular, it is obligated to perform on-board diagnosis (OBD) for detecting such leaks of fuel evaporative gases and, if the leaks are detected, to inform the driver, for example, by lighting a warning lamp. Needless to say, the closed type fuel evaporative emission control apparatus is also required to detect leaks similarly.

To fulfill such requirements, there is, for example, an apparatus available which is designed to detect the presence or absence of leaks of fuel evaporative gases based on a difference between the pressure inside the fuel tank and the atmospheric pressure. Concretely, a forced on-off valve is provided midway through a vapor passage connecting the canister and the fuel tank together, the forced on-off valve is closed except during refueling, and the internal pressure of the fuel tank at the cold start of the engine or in the closed state of the tank with the forced on-off valve being closed at the start is measured. Only on condition that the absolute value of the difference between the internal pressure of the tank and the atmospheric pressure is equal to or higher than a predetermined determination value showing that the airtightness of the fuel tank is fully ensured, it is determined that there is no abnormality, such as leakage, in the fuel tank (See Patent Document 1).

PRIOR ART DOCUMENTS

Patent Documents

[Patent Document 1] Japanese Patent No. 3620402

SUMMARY OF THE INVENTION

Problems to be Solved by the Invention

The above apparatus described in Patent Document 1 can also determine whether leaks of fuel evaporative gases are present or absent, if a pressure sensor for detecting the internal pressure of the fuel tank functions normally.

The above apparatus, however, measures the tank internal pressure with the pressure sensor in a state where there is little change in the pressure inside the fuel tank. Thus, even when an abnormality occurs in the sensor, it is difficult to detect the abnormality. For example, it is likely for the tank internal pressure to be erroneously determined, owing to the sensor abnormality, to be within a proper range.

With the above apparatus, moreover, it is possible to determine whether or not leaks of fuel evaporative gases are present, but it is difficult to specify the location of the leaks.

The present disclosure is made in the light of such circumstances, and aims at providing a fuel evaporative emission control apparatus which can determine whether leaks of fuel evaporative gases are present or absent, can pinpoint the location of the leaks, and can detect a sensor abnormality.

Means for Solving the Problems

According to at least one embodiment, as a first embodiment, of the disclosure, for solving the above problems, there is provided a fuel evaporative emission control apparatus comprising: a first communication passage for communication between an intake passage of an engine of a vehicle and a canister; a second communication passage for communication between the canister and a fuel tank; a third communication passage for communication between the canister and the outside air; a first opening/closing portion, provided in the first communication passage, for opening and closing the first communication passage; a second opening/closing portion, provided in the second communication passage, for opening and closing the second communication passage; a third opening/closing portion, provided in the second communication passage on the side of the canister with respect to a junction of the second communication passage with the first communication passage, for opening and closing the second communication passage; a fourth opening/closing portion, provided in the third communication passage, for opening and closing the third communication passage; a tank pressure detection portion that detects the pressure within the fuel tank; and a determination portion that executes a first leak presence/absence determination for determining the presence or absence of leaks of fuel evaporative gases based on the detection result of the tank pressure detection portion, with the first opening/closing portion being closed, the second opening/closing portion being opened, and the third opening/closing portion being closed.

According to another embodiment of the disclosure, there is provided a fuel evaporative emission control apparatus comprising: a first communication passage for communication between an intake passage of an engine of a vehicle and a canister; a second communication passage for communication between the canister and a fuel tank; a third communication passage for communication between the canister and the outside air; a first opening/closing portion, provided in the first communication passage, for opening and closing the first communication passage; a second opening/closing portion, provided in the second communication passage, for opening and closing the second communication passage; a third opening/closing portion, provided in the second communication passage on the side of the canister with respect to a junction of the second communication passage with the first communication passage, for opening and closing the second communication passage; a fourth opening/closing portion, provided in the third communication passage, for opening and closing the third communication passage; a pressure generation portion that generates a pressure within the canister via the third communication passage; a canister pressure detection portion that detects the pressure within the canister; and a determination portion which executes a first leak location determination for determining the presence or absence of leaks of fuel evaporative gases based on the detection result of the canister pressure detection portion, when the pressure is generated within the canister by the pressure generation portion, with the first opening/closing portion being closed, the second opening/closing portion and the third opening/closing portion being opened, and the fourth opening/closing portion being closed, and if it is determined, by the first leak location determination, that leaks of fuel evaporative gases are present, executes a second leak location determination for determining the presence or absence of leaks of fuel evaporative gases based on the detection result of the canister pressure detection portion, when the pressure is generated within the canister, with the third opening/closing portion being switched from an open state to a closed state.

Effects of the Invention

With the present disclosure described above, the presence or absence of leaks of fuel evaporative gases can be determined appropriately, and the location of the leaks can be pinpointed. Moreover, an abnormality of the pressure sensor or the like used in the determination of leaks can be detected.

MODE FOR CARRYING OUT THE INVENTION

An embodiment of the present invention will now be described in detail with reference to the accompanying drawings.

Figure 1:
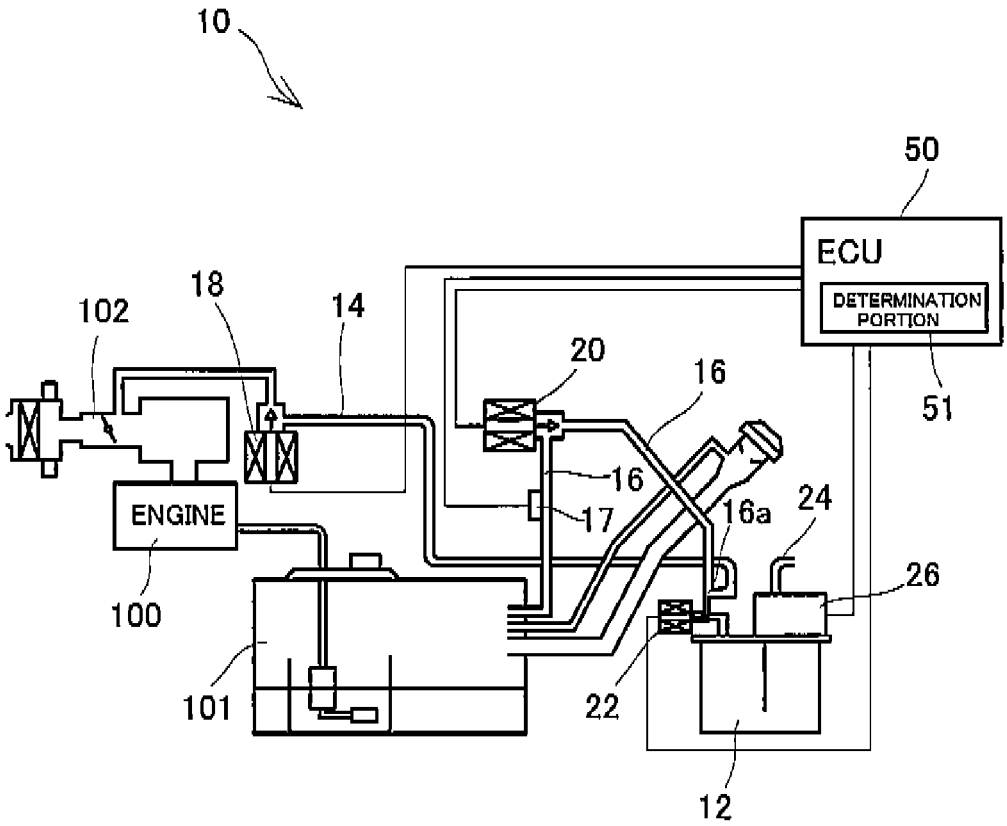
FIG. 1 is a schematic configuration diagram showing a fuel evaporative emission control apparatus according to an embodiment of the present invention.

As shown in FIG. 1, a fuel evaporative emission control apparatus 10 according to the present embodiment is an apparatus, loaded on a vehicle such as an automobile, for restraining fuel evaporative gases (vapors), which occur within a fuel tank 101 storing fuel to be supplied to an engine 100, from being emitted into the atmosphere.

The fuel evaporative emission control apparatus 10 is equipped with a canister 12 having activated carbon sealed therein. The canister 12 communicates with an intake passage 102 of the engine via purge piping (first communication passage) 14, and also communicates with, the fuel tank 101 via vapor piping (second communication passage) 16. The vapor piping 16 is provided with a tank pressure sensor (tank pressure detection portion) 17 for detecting the pressure inside the fuel tank 101. Hereinafter, the pressure detected by the tank pressure sensor 17 will also be referred to simply as "tank pressure".

The purge piping 14 is provided with a purge valve (first opening/closing portion) 18 for opening and closing the purge piping 14. By switching, as appropriate, between the open and closed states of the purge valve 18, the state of supply, to the intake passage 102, of fuel adsorbed by the canister 12 is controlled. The purge valve 18 is driven, for example, by an electromagnetic solenoid. The purge valve 18 is a so-called normally closed type electromagnetic valve, and is closed when the electromagnetic solenoid is not energized, and is opened upon energization of the electromagnetic solenoid.

The end of the purge piping 14 on the side opposite to the intake passage 102 is connected to a part of the vapor piping 16 in the vicinity of the canister 12. A containment valve (second opening/closing portion) 20 for opening and closing the vapor piping 16 is provided on a side of the vapor piping 16 toward the fuel tank 101 with respect to a junction 16*a* of the vapor piping 16 with the purge piping 14. Further, an on-off valve (third opening/closing portion) 22 is provided on a side of the vapor piping 16 toward the canister 12 with respect to the junction 15*a* of the vapor piping 16 with the purge piping 14. The containment valve 20 is a so-called normally closed type electromagnetic valve like the purge valve 18, while the on-off valve 22 is a so-called normally open type electromagnetic valve unlike the purge valve 18 or the like.

Vent piping (third communication passage) 24 is connected to the canister 12, and the canister 12 communicates with the outside via the vent piping 24. Midway through the vent piping 24 is provided an evaporative leak check module (ELCM) 26 for detecting leaks from the fuel tank 101, the canister 12, and the purge piping 14 and vapor piping 16 linked thereto.

Figure 2A:
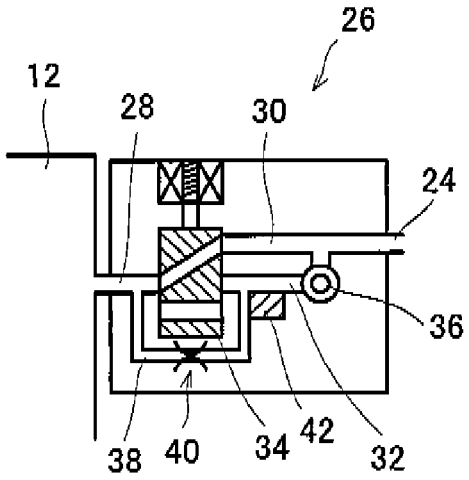
FIGS. 2A, 2B are views showing the schematic configuration of an evaporative leak check module.
Figure 2B:
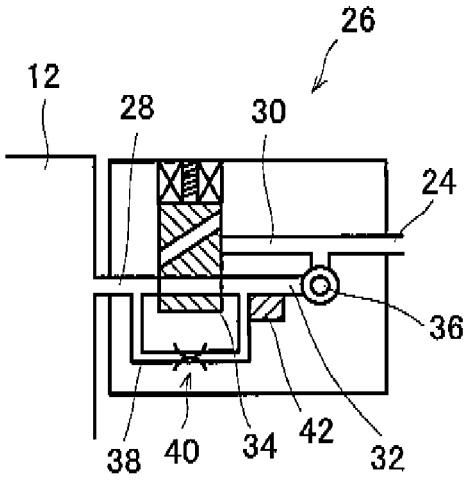

As shown in FIGS. 2A, 2B, the ELCM 26 is equipped with a first flow path 28 communicating with the canister 12, a second flow path 30 opening into the atmosphere via the vent piping 24, and a third flow path 32 connected halfway between the first flow path 28 and the second flow path 30. A switching valve (fourth opening/closing portion) 34 is provided between the first flow path 28 and the second flow path 30 and between the first flow path 28 and the third flow path 32.

The connection of the first flow path 28 with the second flow path 30 or the third flow path 32 can be switched by the switching valve 34. The switching valve 34, for example, establishes communication between the first flow path 28 and the second flow path 30 when the electromagnetic solenoid is not energized, and establishes communication between the first flow path 28 and the third flow path 32 when the electromagnetic solenoid is energized.

On the third flow path 32, a negative pressure pump 36 is provided which generates a negative pressure inside the canister 12. The first flow path 28 and the third flow path 32 have a fourth flow path 38 provided astride the switching valve 34. The fourth flow path 38 is provided with a reference orifice 40, say, of a 0.5 mm diameter, and a canister pressure sensor (canister pressure detection portion) 42 for detecting the pressure inside the canister 12 is provided toward the second flow path 30 with respect to the reference orifice 40. Hereinafter, the pressure detected by the canister pressure sensor 42 will also be referred to simply as "canister pressure".

The negative pressure pump (pressure generation portion) 36 constituting the above-described ELCM 26, and the aforementioned purge valve 18, containment valve 20, and on-off valve 22 are controlled based on control signals from an ECU 50. The ECU 50 has a determination portion 51, and the determination portion 51 executes a leak presence/absence determination and a leak location determination for determining whether leaks of fuel evaporative gases are present or absent and where the leaks occur. Concretely, determinations of the possibility of leak occurrence and the location of the leaks are made based on changes in the tank pressure when the containment valve 20 is switched from a closed state to an open state. Further, a negative pressure is generated within the canister 12 by the negative pressure pump 36 in a predetermined state, and the pressure on this occasion is detected by the canister pressure sensor 42 or the tank pressure sensor 17. Based on the results of the detection, the determination portion 51 determines the presence or absence of leaks and the location of the leaks. If the determination portion 51 determines that leaks are present, the driver is warned, for example, by lighting a warning lamp for leak indication which is provided at the driver's seat.

Figure 3A:
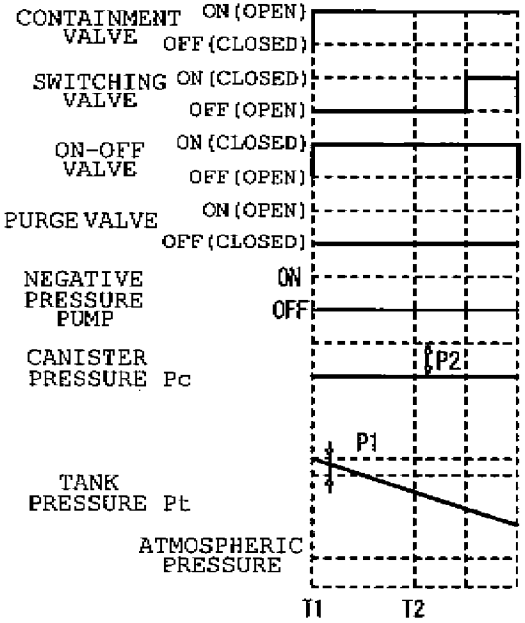
FIGS. 3A to 3C are timing charts illustrating the operating states of valves, etc. in determining the presence or absence of leaks.
Figure 3B:
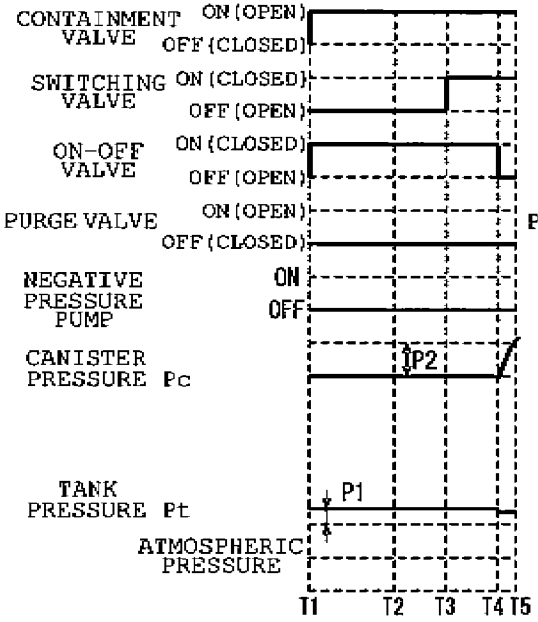
Figure 3C:
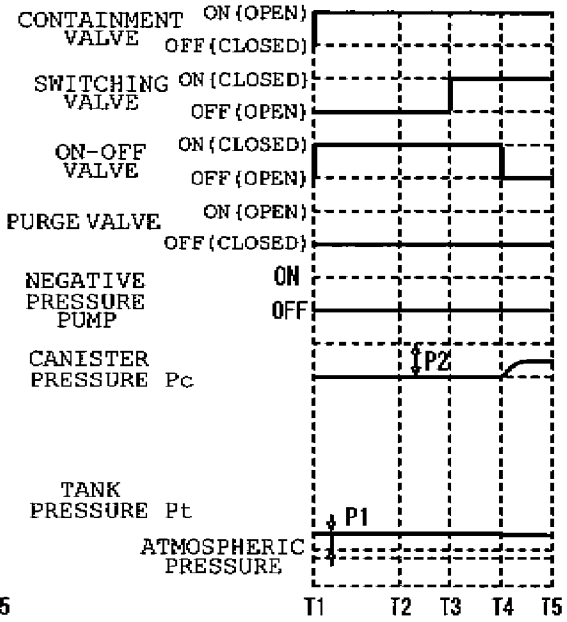
Figure 4:
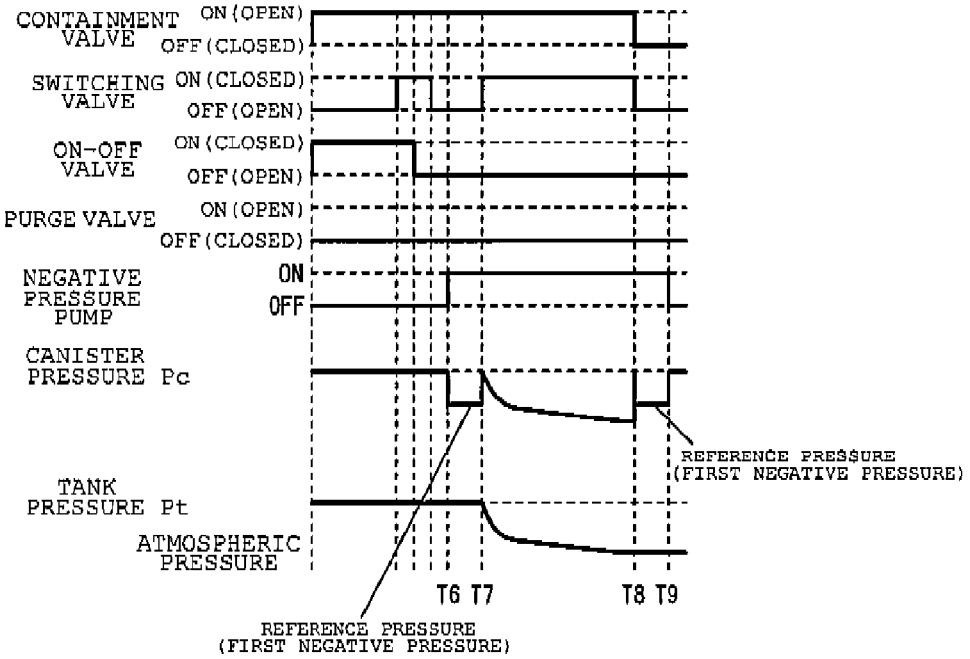
FIG. 4 is a timing chart illustrating the operating states of the valves, etc. in determining the location of leaks.

Methods for detecting the presence or absence of leaks and the location of the leaks by the determination portion 51 will be described below by reference to FIGS. 3A to 3C and FIG. 4. FIGS. 3A to 3C are timing charts chronologically illustrating the operating states of the respective valves, the canister pressure, and the tank pressure in the determination of the presence or absence of leaks (first leak presence/absence determination and second leak presence/absence determination). FIG. 4 is a timing chart chronologically illustrating the operating states of the respective valves, the canister pressure, and the tank pressure in the determination of the location of leaks (first leak location determination and second leak location determination).

The determination port ion 51 executes a leak presence/absence determination, without actuating the negative pressure pump, for example, during a key-off. First of all, a first leak presence/absence determination is executed to determine the presence or absence of leaks of fuel evaporative gases (possibility of leak occurrence) on a side of the fuel tank 101 with respect to the on-off valve 22, namely, within the path except the canister 12, based on the tank pressure.

The first leak presence/absence determination is executed during the period T1-T2 shown in FIGS. 3A to 3C. Before start of the first leak presence/absence determination, the purge valve 18 and the containment valve 20 are controlled to a closed state, while the switching valve 34 and the on-off valve 22 are controlled to an open state. In this situation, the fuel tank 101 is closed with the containment valve 20. If, at this time, there are no leaks in the fuel tank 101, i.e., under normal conditions, the tank pressure can be any of a positive pressure, a negative pressure, and a pressure close to the atmospheric pressure. If leaks occur in the fuel tank 101, on the other hand, the tank pressure is not a positive or negative pressure, but is close to the atmospheric pressure.

Then, at a time T1, the on-off valve 22 is switched to a closed state, and the containment valve 20 is switched to an open state. As a result, the fuel tank 101, the purge piping 14 and the vapor piping 16 are brought into communication. Based on a change in the tank pressure on this occasion, namely, a change in the pressure value detected by the tank pressure sensor 17, the determination portion 51 determines whether or not there are leaks in the fuel tank 101, the purge piping 14 or the vapor piping 16. That is, when the absolute value of the amount of change in the tank pressure exceeds a predetermined value, it is determined that there is the possibility of leaks. If the tank pressure Pt at the time T1 is a positive pressure, for example, it is determined whether the tank pressure Pt has lowered beyond a preset first threshold value P1.

In an example shown in FIG. 3A, the tank pressure Pt has lowered beyond the first threshold value P1 during the period T1-T2. Thus, it is determined that there is the possibility of leaks occurring somewhere in the fuel tank 101, the purge piping 14 and the vapor piping 16. If the tank pressure Pt is held at a positive pressure as stated above, when the first leak presence/absence determination is initiated to switch the containment valve 20 to an open state, the tank pressure slightly lowers even in a normal state without leakage. However, the volume of the fuel tank 101 is by far larger than the volumes of the purge piping 14 and the vapor piping 16. As shown in FIGS. 3B and 3C, therefore, a decrease in the tank pressure under normal conditions is extremely small. Hence, when the tank pressure Pt has lowered beyond the first threshold value P1 at the time of the first leak presence/absence determination, it can be determined that there is the possibility of leaks occurring somewhere in the fuel tank 101, the purge piping 14 and the vapor piping 16.

In the example shown in FIG. 3A, the tank pressure Pt is held at the positive pressure, at the time T1 when the containment valve 20 is in the closed state. Thus, it can be determined that there are no leaks in the fuel tank 101. In conclusion, it can be determined that the leaks occur in one of the purge piping 14 and the vapor piping 16.

As shown in FIGS. 3B, 3C, by contrast, when the tank pressure Pt has not lowered beyond the first threshold value P1 during T1-T2, it cannot be determined that there is the possibility of leaks occurring in the fuel tank 101, the purge piping 14 or the vapor piping 16. Thus, a second leak presence/absence determination is further executed to determine the presence/absence of leaks in the fuel tank 101, the purge piping 14 or the vapor piping 16.

Concretely, as shown in FIGS. 3B, 3C, the switching valve 34 is switched to a closed state, namely, a state where the first flow path 28 and the third flow path 32 constituting the ELCM 26 are connected together, at a time T3, and then, at a time T4, the on-off valve 22 is switched to an open state. As a result, the canister 12 as well as the aforementioned fuel tank 101, purge piping 14 and vapor piping 16 is brought into communication. Based on a change in the canister pressure on this occasion, the determination portion 51 determines the presence or absence of leaks in the fuel tank 101, the purge piping 14 or the vapor piping 16. That is, with the second leak presence/absence determination, it is determined that leaks are present when the canister pressure Pc rises or lowers beyond a preset threshold value during the period T4-T5. That is, when the absolute value of the amount of change in the canister pressure has exceeded the threshold value, the presence of leaks is determined.

For example, when the tank pressure Pt at the time T1 is a positive pressure as mentioned above, the canister pressure Pc rises during T4-T5, as shown in FIGS. 3B, 3C. According to the second leak presence/absence determination, therefore, a determination is made as to whether or not the amount of change (amount of rise) in the canister pressure Pc during T4-T5 has exceeded a second threshold value P2.

The switching valve 34 remains in an open state, namely, a state where the first flow path 28 and the second flow path 30 are in communication to open the canister 12 into the atmosphere, until the time T3. Thus, in a case in which the tank pressure Pt is held positive at the time T1 as mentioned above, when the on-off valve 22 is to be switched to an open state at the time T4, the canister pressure Pc is a pressure which is much lower than the tank pressure Pt and close to the atmospheric pressure. Thus, when the on-off valve 22 is switched to an open state at the time T4, the canister pressure Pc, under normal conditions, rises greatly under the influence of the tank pressure Pt. Therefore, if the canister pressure Pc rises beyond the second threshold value P2 during the period. T4-T5 (FIG. 3B), for example, it can be determined that no leaks are present in the fuel tank 101, the purge piping 14 and the vapor piping 16. When the canister pressure Pc rises beyond the second threshold value P2 during T4-T5, as noted here, it can be determined that there are no abnormalities (e.g., fixation) of the on-off valve 22 and the containment valve 20.

If the canister pressure Pc fails to reach the second threshold value P2 during T4-T5 upon switching of the on-off valve 22 to an open state (FIG. 3C), it is difficult to determine whether or not there are leaks in the fuel tank 101, the purge piping 14 or the vapor piping 16. That is, the possibility of leakage in the fuel tank 101, the purge piping 14 or the vapor piping 16 cannot be completely denied. Hence, the determination port ion 51 further executes a leak location determination (first leak location determination and second leak location determination), as will be described below.

Figure 5A:
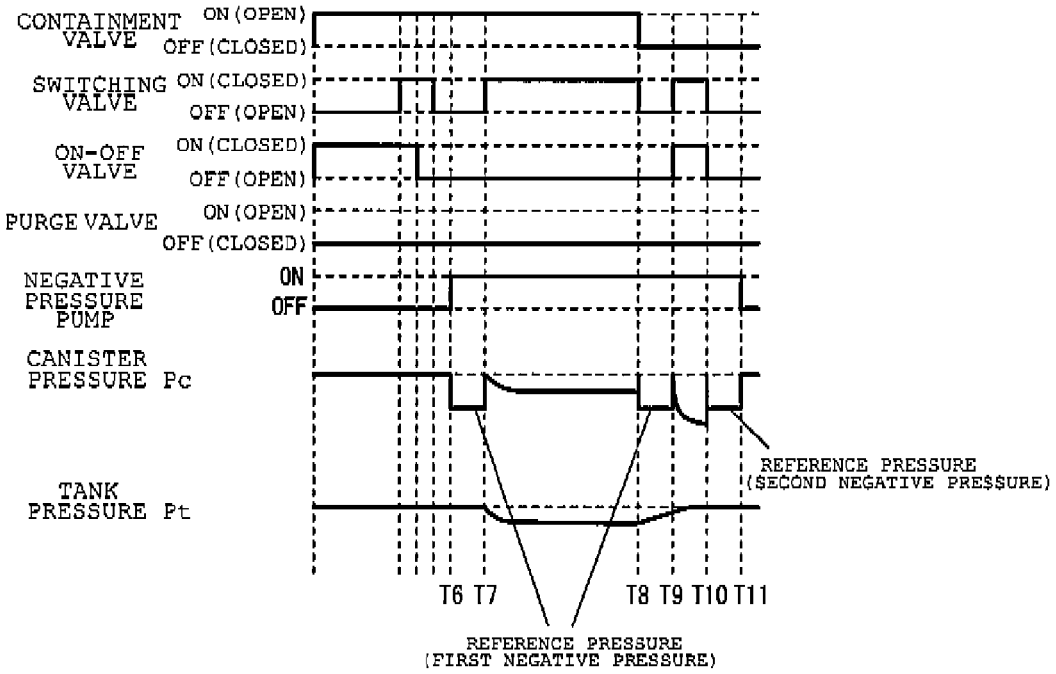
FIGS. 5A, 5B are timing charts illustrating the operating states of the valves, etc. in determining the location of leaks.
Figure 5B:
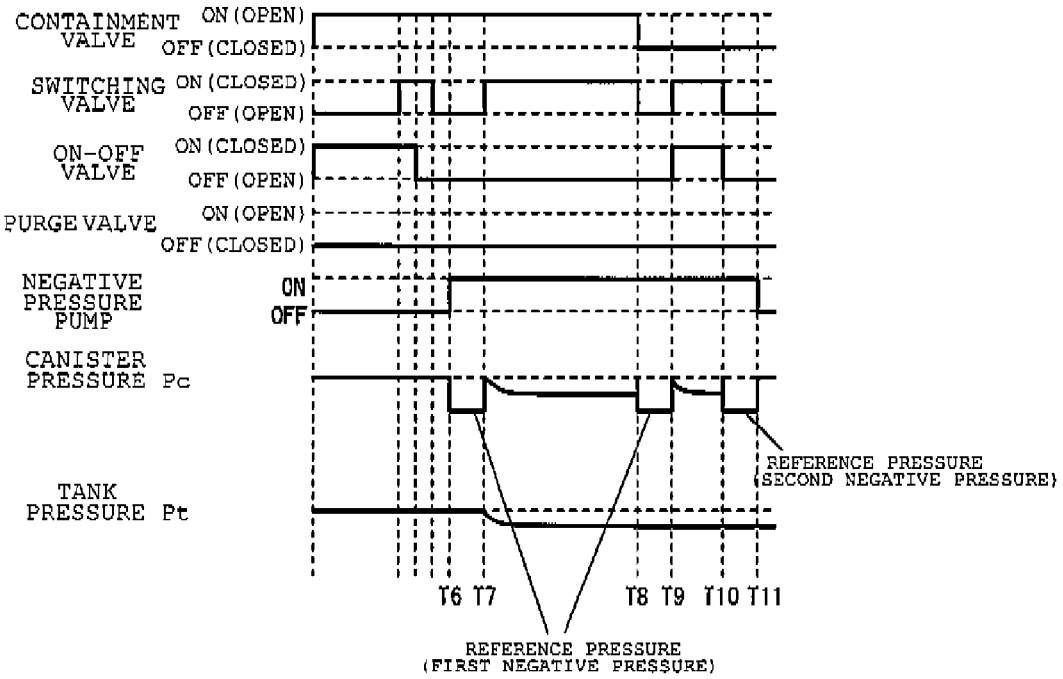

With the first leak location determination, the presence or absence of leaks is determined according to the canister pressure Pc. As shown in FIGS. 4 and 5A, 5B, the first step is to bring the purge valve 18 into a closed state, bring the containment valve 20, switching valve 34 and on-off valve 22 into an open state and, at a time T6, actuate the negative pressure pump 36. By this procedure, a negative pressure is generated in the canister 12 (actually, a negative pressure is generated in the third flow path 32 between the negative pressure pump 36 and the reference orifice 40), and the canister pressure on this occasion is detected for use as a reference pressure (first negative pressure). Then, at a time T7, the switching valve 34 is switched to a closed state to connect the first flow path 28 and the third flow path 32 together. During the period T7-T8, a change in the canister pressure is detected. Then, at a time T8, the switching valve 34 is switched to an open state to connect the first flow path 28 and the second flow path 30 together. Then, during the period T8-T9, the canister pressure is detected and used again as a reference pressure (first negative pressure).

If the canister pressure Pc is lower than the redetected reference pressure (first negative pressure), that is, greater in negative pressure than the reference pressure (first negative pressure), as shown in FIG. 4, it is determined that leaks are absent in both of the fuel tank 101 and the canister 12. If the pressure detected during T7-T8 is greater than the reference pressure (first negative pressure) detected again during T8-T9, that is, lower in negative pressure than the reference pressure (first negative pressure), as shown in FIGS. 5A, 5B, it is determined that there is a hole larger than the inner diameter of the reference orifice 40. That is, it is determined that leaks occur in the fuel tank 101 or the canister 12 or somewhere in each communication passage.

In this case, the determination portion 51 further executes a second leak location determination to determine whether leaks are present or not. In detail, as shown in FIGS. 5A, 5B, after the first determination, at the time T9, the switching valve 34 is switched to a closed state to connect the first flow path 28 and the third flow path 32 together, and the on-off valve 22 is also switched to a closed state to detect a change in the canister pressure Pc during T9-T10. Moreover, at the time T10, the switching valve 34 is switched to an open state to connect the first flow path 28 and the second flow path 30 together, and the on-off valve 22 is switched to an open state to detect the canister pressure Pc during T10-T11, thereby using it as a reference pressure (second negative pressure) again.

If the canister pressure Pc detected during T9-T10 is lower than the reference pressure (second negative pressure) redetected during T10-T11, that is, greater in negative pressure than the reference pressure (second negative pressure), as shown in FIG. 5A, it is determined that no leaks are present in the canister 12. Consequently, it can be determined that leaks occur on the side of the fuel tank 101 with respect to the on-off valve 22. If the canister pressure Pc is greater than the reference pressure (second negative pressure) redetected during T10-T11, that is, lower in negative pressure than the reference pressure (second negative pressure), as shown in FIG. 5B, it is determined that there is a hole in the canister 12 which is larger than the inner diameter of the reference orifice 40. That is, it is determined that leaks occur on the side of the canister 12 with respect to the on-off valve 22.

Figure 6:
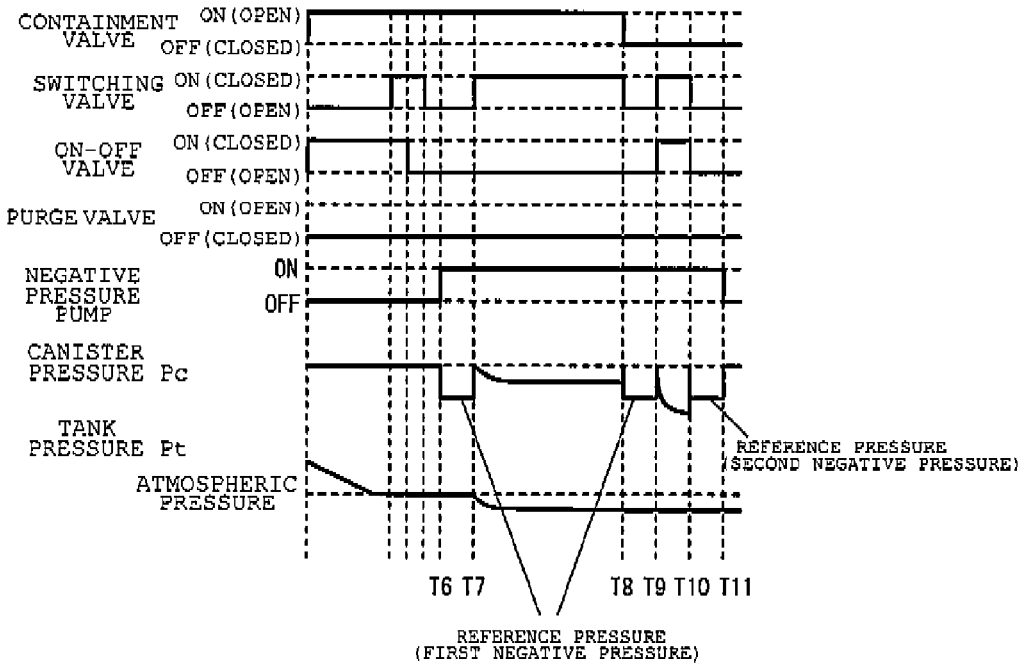
FIG. 6 is a timing chart illustrating the operating states of the valves, etc. in determining the location of leaks.

According to the present embodiment, as described above, if it is determined by the first leak presence/absence determination that there is the possibility of leaks occurring somewhere in the fuel tank 101, the purge piping 14 or the vapor piping 16, the second leak presence/absence determination is not executed, but the aforementioned first leak location determination and second leak location determination are executed. In this case, the possibility exists that leaks occur somewhere in the purge piping 14 or the vapor piping 16. If the first leak presence/absence determination is correct, therefore, a change in the canister pressure Pc during T7-T8 according to the first leak location determination is smaller than the reference pressure (first negative pressure) redetected during T8-T9, as shown in FIG. 6. If the canister pressure Pc is lower than the reference pressure (first negative pressure), that is, greater in negative pressure than the reference pressure (first negative pressure), it can be determined that there is an abnormality in the tank pressure sensor 17 or the like used in the first leak presence/absence determination.

If, upon further execution of the second leak location determination, the canister pressure Pc detected during T9-T10 is lower than the reference pressure (second negative pressure) redetected during T10-T11, that is, greater in negative pressure than the reference pressure (second negative pressure), as shown in FIG. 6, it can be determined that no leaks are present in the canister 12. As a consequence, it can be confirmed that leaks occur on the side of the fuel tank 101 with respect to the on-off valve 22. If, at this time, the canister pressure Pc is greater than the reference pressure (second negative pressure) redetected during T10-T11, that is lower in negative pressure than the reference pressure (second negative pressure), it can be determined that leaks occur somewhere in the fuel tank 101, the purge piping 14 or the vapor piping 16, and it can also be determined that leaks are present on the side of the canister 12 as well.

According to the present invention, as described above, the first leak presence/absence determination and the second leak presence/absence determination are executed, as appropriate, to determine the presence or absence of leaks (the possibility of leak occurrence) of fuel evaporative gases. By so doing, the presence or absence of leaks can be determined appropriately, and the location of leaks can be specified to some extent. Moreover, the first leak presence/absence determination and the second leak presence/absence determination are executed, with the negative pressure pump being at a standstill. Thus, the amount of electric power consumed by the leak determinations can be cut down.

With the present embodiment, moreover, after the leak presence/absence determination (first leak presence/absence determination and second leak presence/absence determination), the leak location determination (first leak location determination and second leak location determination) is executed further. Thus, the presence or absence of leaks and the location of the leaks can be determined more appropriately.

Furthermore, according to the present invention, the presence or absence of leaks is determined based on the amount of change in the tank pressure or the canister pressure. Hence, if the tank pressure or the canister pressure remains unchanged because of an abnormality occurring in the tank pressure sensor 17 or the canister pressure sensor 42, an abnormality of the sensor can be easily detected.

The present invention has been described above in regard to one embodiment thereof, but it is to be understood that the present invention is in no way limited to this embodiment. The present invention can be changed and modified, as appropriate, without departing from its scope and spirit.

In the above embodiment, for example, the explanations have been offered for the example in which when the tank pressure is a positive pressure, the presence or absence of leaks is determined depending on whether the tank pressure has lowered beyond the predetermined threshold value, as the first leak presence/absence determination. According to the first leak presence/absence determination above, when the absolute value of the amount of change in the tank pressure exceeds the predetermined value, it can be determined that the possibility of leakage exists. Thus, under the tank pressure which is a negative pressure, for example, when the tank pressure rises beyond the predetermined threshold value, it can be determined that there is the possibility of leak occurrence.

In the above embodiment, for example, the negative pressure pump for generating a negative pressure in the canister is used as the pressure generation portion, and the reference pressure in the leak location determination is set to be a negative pressure. However, a booster pump for pressurizing (generating a positive pressure in) the canister is used as the pressure generation portion, and the reference pressure in the leak location determination is set to be a positive pressure.

In the above embodiment, moreover, the explanations have been offered for the example in which the leak presence/absence determination (first leak presence/absence determination and second leak presence/absence determination) and the leak location determination (first leak location determination and second leak location determination) are executed. However, only one of the leak presence/absence determination and the leak location determination may be executed. In performing only the leak presence/absence determination, it is not absolutely necessary to execute each of the first leak presence/absence determination and the second leak presence/absence determination, and only the first leak presence/absence determination may be executed.

EXPLANATIONS OF LETTERS OR NUMERALS

10 Fuel evaporative emission control apparatus
12 canister
14 Purge piping (first communication passage)
16 Vapor piping (second communication passage)
**16*a*** Junction
17 Tank pressure sensor (tank pressure detection portion)
18 Purge valve (first opening/closing portion)
20 Containment valve (second opening/closing portion)
22 On-off valve (third opening/closing portion)
24 Vent piping (third communication passage)
26 Evaporative leak check module (ELCM)
28 First flow path
30 Second flow path
32 Third flow path
34 Switching valve (fourth opening/closing portion)
36 Negative pressure pump (pressure generation portion)
38 Fourth flow path
40 Reference orifice
42 Canister pressure sensor (canister pressure detection portion)
50 ECU
51 Determination portion
100 Engine
101 Fuel tank
102 Intake passage

The invention claimed is:

1. A fuel evaporative emission control apparatus, comprising:

a first communication passage for communication between an intake passage of an engine of a vehicle and a canister;

a second communication passage for communication between the canister and a fuel tank;

a junction at which the first communication passage is connected to the second communication passage;

a third communication passage for communication between the canister and outside air;

a first opening/closing portion, provided in the first communication passage, for opening and closing the first communication passage;

a second opening/closing portion, provided in the second communication passage, for opening and closing the second communication passage;

a third opening/closing portion, provided in the second communication passage on a side of the canister with respect to the junction of the second communication passage with the first communication passage, for opening and closing the second communication passage;

a fourth opening/closing portion, provided in the third communication passage, for opening and closing the third communication passage;

a tank pressure detection portion that detects a pressure within the fuel tank; and a determination portion that executes a first leak presence/absence determination for determining presence or absence of leaks of fuel evaporative gases based on a detection result of the tank pressure detection portion, with the first opening/closing portion being closed, the second opening/closing portion being opened, and the third opening/closing portion being closed.

2. The fuel evaporative emission control apparatus according to claim 1, further comprising:

a pressure generation portion that generates a pressure within the canister via the third communication passage; and a canister pressure detection portion that detects the pressure within the canister, wherein if the determination portion does not determine by the first leak presence/absence determination that there are leaks of fuel evaporative gases in the fuel tank, the determination portion further executes a second leak presence/absence determination for determining presence or absence of leaks of fuel evaporative gases based on a detection result of the canister pressure detection portion, when the third opening/closing portion is switched from a closed state to an open state, with the pressure generation portion being at a standstill, the first opening/closing portion being closed, the second opening/closing portion being opened, and the fourth opening/closing portion being closed.

3. The fuel evaporative emission control apparatus according to claim 2, wherein when the amount of change in the canister pressure exceeds to a preset threshold value within a predetermined time during the second leak presence/absence determination, the determination portion determines that there are no leaks of fuel evaporative gases.

4. The fuel evaporative emission control apparatus according to claim 2, wherein if the determination portion determines by the first leak presence/absence determination that there are leaks of fuel evaporative gases in the fuel tank, the determination portion further executes, after the first leak presence/absence determination, a first leak location determination for determining presence or absence of leaks of fuel evaporative gases based on a detection result of the canister pressure detection portion, when the pressure is generated within the canister by the pressure generation portion, with the second opening/closing portion and the third opening/closing portion being opened, and the fourth opening/closing portion being closed, and a second leak location determination for determining a location of leaks of fuel evaporative gases based on a detection result of the canister pressure detection portion, when the pressure is generated within the canister, with the second opening/closing portion and the third opening/closing portion being switched to a closed state.

5. The fuel evaporative emission control apparatus according to claim 3, wherein if the determination portion determines by the first leak presence/absence determination that there are leaks of fuel evaporative gases in the fuel tank, the determination portion further executes, after the first leak presence/absence determination, a first leak location determination for determining presence or absence of leaks of fuel evaporative gases based on a detection result of the canister pressure detection portion, when the pressure is generated within the canister by the pressure generation portion, with the second opening/closing portion and the third opening/closing portion being opened, and the fourth opening/closing portion being closed, and a second leak location determination for determining a location of leaks of fuel evaporative gases based on a detection result of the canister pressure detection portion, when the pressure is generated within the canister, with the second opening/closing portion and the third opening/closing portion being switched to a closed state.

6. A fuel evaporative emission control apparatus, comprising:

a first communication passage for communication between an intake passage of an engine of a vehicle and a canister;

a second communication passage for communication between the canister and a fuel tank;

a third communication passage for communication between the canister and outside air;

a first opening/closing portion, provided in the first communication passage, for opening and closing the first communication passage;

a second opening/closing portion, provided in the second communication passage, for opening and closing the second communication passage;

a third opening/closing portion, provided in the second communication passage on a side of the canister with respect to a junction of the second communication passage with the first communication passage, for opening and closing the second communication passage;

a fourth opening/closing portion, provided in the third communication passage, for opening and closing the third communication passage;

a pressure generation portion that generates a pressure within the canister via the third communication passage;

a canister pressure detection portion that detects the pressure within the canister; and a determination portion which executes a first leak location determination for determining presence or absence of leaks of fuel evaporative gases based on a detection result of the canister pressure detection portion, when the pressure is generated within the canister by the pressure generation portion, with the first opening/closing portion being closed, the second opening/closing portion and the third opening/closing portion being opened, and the fourth opening/closing portion being closed, and if it is determined, by the first leak location determination, that leaks of fuel evaporative gases are present, executes a second leak location determination for determining presence or absence of leaks of fuel evaporative gases based on a detection result of the canister pressure detection portion, when the pressure is generated within the canister, with the third opening/closing portion being switched from an open state to a closed state.

7. The fuel evaporative emission control apparatus according to claim 6, wherein in executing the first leak location determination, the determination portion determines that leaks are present when the detection result of the canister pressure detection portion fails to reach a preset first pressure.

8. The fuel evaporative emission control apparatus according to claim 6, wherein in executing the second leak location determination, the determination portion determines that leaks occur on a side of the canister with respect to the third opening/closing portion when the detection result of the canister pressure detection portion fails to reach a preset second pressure, and determines that leaks occur on a side of the fuel tank with respect to the third opening/closing portion when the detection result of the canister pressure detection portion exceeds the second pressure.

9. The fuel evaporative emission control apparatus according to claim 7, wherein in executing the second leak location determination, the determination portion determines that leaks occur on a side of the canister with respect to the third opening/closing portion when the detection result of the canister pressure detection portion fails to reach a preset second pressure, and determines that leaks occur on a side of the fuel tank with respect to the third opening/closing portion when the detection result of the canister pressure detection portion exceeds the second pressure.

10. The fuel evaporative emission control apparatus according to claim 6, further comprising:

a tank pressure detection portion that detects a pressure within the fuel tank, wherein the determination portion executes, prior to the first leak location determination, a leak presence/absence determination for determining presence or absence of leaks of fuel evaporative gases based on detection results of the canister pressure detection portion and the tank pressure detection portion, and if it is not determined, by the leak presence/absence determination, that leaks of fuel evaporative gases are absent, executes the first leak location determination.

11. The fuel evaporative emission control apparatus according to claim 7, further comprising:

a tank pressure detection portion that detects a pressure within the fuel tank, wherein the determination portion executes, prior to the first leak location determination, a leak presence/absence determination for determining presence or absence of leaks of fuel evaporative gases based on detection results of the canister pressure detection portion and the tank pressure detection portion, and if it is not determined, by the leak presence/absence determination, that leaks of fuel evaporative gases are absent, executes the first leak location determination.

12. The fuel evaporative emission control apparatus according to claim 8, further comprising:

a tank pressure detection portion that detects a pressure within the fuel tank, wherein the determination portion executes, prior to the first leak location determination, a leak presence/absence determination for determining presence or absence of leaks of fuel evaporative gases based on detection results of the canister pressure detection portion and the tank pressure detection portion, and if it is not determined, by the leak presence/absence determination, that leaks of fuel evaporative gases are absent, executes the first leak location determination.

13. The fuel evaporative emission control apparatus according to claim 9, further comprising:

a tank pressure detection portion that detects a pressure within the fuel tank, wherein the determination portion executes, prior to the first leak location determination, a leak presence/absence determination for determining presence or absence of leaks of fuel evaporative gases based on detection results of the canister pressure detection portion and the tank pressure detection portion, and if it is not determined, by the leak presence/absence determination, that leaks of fuel evaporative gases are absent, executes the first leak location determination.

14. The fuel evaporative emission control apparatus according to claim 10, wherein in executing the leak presence/absence determination, the determination portion does not determine that leaks of fuel evaporative gases are absent, but executes the first leak location determination, when the pressure of the fuel tank, with the second opening/closing portion being opened, and the first opening/closing portion and the third opening/closing portion being closed, lowers by more than a preset first threshold value within a predetermined time, or even in a case where the pressure of the fuel tank, with the second opening/closing portion being opened, and the first opening/closing portion and the third opening/closing portion being closed, does not lower by more than the preset first threshold value within the predetermined time, when upon subsequent switching of the third opening/closing portion from a closed state to an open state, with the second opening/closing portion being opened, the first opening/closing portion and the fourth opening/closing portion being closed, and the pressure generation portion being stopped, the amount of change in the canister pressure exceeds a preset second threshold value within a predetermined time.

15. The fuel evaporative emission control apparatus according to claim 11, wherein in executing the leak presence/absence determination, the determination portion does not determine that leaks of fuel evaporative gases are absent, but executes the first leak location determination, when the pressure of the fuel tank, with the second opening/closing portion being opened, and the first opening/closing portion and the third opening/closing portion being closed, lowers by more than a preset first threshold value within a predetermined time, or even in a case where the pressure of the fuel tank, with the second opening/closing portion being opened, and the first opening/closing portion and the third opening/closing portion being closed, does not lower by more than the preset first threshold value within the predetermined time, when upon subsequent switching of the third opening/closing portion from a closed state to an open state, with the second opening/closing portion being opened, the first opening/closing portion and the fourth opening/closing portion being closed, and the pressure generation portion being stopped, the amount of change in the canister pressure exceeds a preset second threshold value within a predetermined time.

16. The fuel evaporative emission control apparatus according to claim 12, wherein in executing the leak presence/absence determination, the determination portion does not determine that leaks of fuel evaporative gases are absent, but executes the first leak location determination, when the pressure of the fuel tank, with the second opening/closing portion being opened, and the first opening/closing portion and the third opening/closing portion being closed, lowers by more than a preset first threshold value within a predetermined time, or even in a case where the pressure of the fuel tank, with the second opening/closing portion being opened, and the first opening/closing portion and the third opening/closing portion being closed, does not lower by more than the preset first threshold value within the predetermined time, when upon subsequent switching of the third opening/closing portion from a closed state to an open state, with the second opening/closing portion being opened, the first opening/closing portion and the fourth opening/closing portion being closed, and the pressure generation portion being stopped, the amount of change in the canister pressure exceeds a preset second threshold value within a predetermined time.

17. The fuel evaporative emission control apparatus according to claim 13, wherein in executing the leak presence/absence determination, the determination portion does not determine that leaks of fuel evaporative gases are absent, but executes the first leak location determination, when the pressure of the fuel tank, with the second opening/closing portion being opened, and the first opening/closing portion and the third opening/closing portion being closed, lowers by more than a preset first threshold value within a predetermined time, or even in a case where the pressure of the fuel tank, with the second opening/closing portion being opened, and the first opening/closing portion and the third opening/closing portion being closed, does not lower by more than the preset first threshold value within the predetermined time, when upon subsequent switching of the third opening/closing portion from a closed state to an open state, with the second opening/closing portion being opened, the first opening/closing portion and the fourth opening/closing portion being closed, and the pressure generation portion being stopped, the pressure amount of change in the canister pressure exceeds a preset second threshold value within a predetermined time.

18. The fuel evaporative emission control apparatus according to claim 14, wherein if it is determined, by the leak presence/absence determination, that leaks of fuel evaporative gases are absent, the first leak location determination is not executed, but the second leak location determination is executed.

19. The fuel evaporative emission control apparatus according to claim 15, wherein if it is determined, by the leak presence/absence determination, that leaks of fuel evaporative gases are absent, the first leak location determination is not executed, but the second leak location determination is executed.

20. The fuel evaporative emission control apparatus according to claim 16, wherein if it is determined, by the leak presence/absence determination, that leaks of fuel evaporative gases are absent, the first leak location determination is not executed, but the second leak location determination is executed.

* * * * *